United States Patent [19]

Richards

[11] Patent Number: 4,778,108

[45] Date of Patent: Oct. 18, 1988

[54] SPIGOT WATER FOUNTAIN

[76] Inventor: Marvin D. Richards, 418 Del Sol, Pleasanton, Calif. 94566

[21] Appl. No.: 14,811

[22] Filed: Feb. 13, 1987

[51] Int. Cl.[4] ..... B02B 15/08

[52] U.S. Cl. ..... 239/26; 239/587; 137/801

[58] Field of Search ..... 239/587, 25-27, 239/31, 32; 137/801

[56] References Cited

U.S. PATENT DOCUMENTS

| | | | |
|---|---|---|---|
| 487,842 | 12/1892 | King . | |
| 1,096,021 | 5/1914 | Day . | |
| 1,114,051 | 10/1914 | Schwartz . | |
| 1,149,856 | 8/1915 | Piper | 239/25 |
| 1,994,454 | 3/1935 | Cross . | |
| 2,474,286 | 6/1949 | Snyder . | |
| 2,790,632 | 4/1957 | Mellette | 239/26 |
| 2,878,059 | 3/1959 | Limle | 239/587 |
| 2,971,701 | 2/1961 | Shames et al. | 239/587 |
| 2,994,481 | 8/1961 | Blumberg . | |
| 3,062,452 | 11/1962 | Knight . | |
| 3,079,088 | 2/1963 | Hermann et al. . | |
| 3,108,748 | 10/1963 | Fiore . | |
| 3,533,554 | 10/1970 | Mongerson . | |
| 3,682,392 | 8/1972 | Kint . | |

FOREIGN PATENT DOCUMENTS

| | | | |
|---|---|---|---|
| 2304729 | 10/1976 | France | 137/801 |

*Primary Examiner*—Andres Kashnikow
*Assistant Examiner*—Karen B. Merritt
*Attorney, Agent, or Firm*—Bielen and Peterson

[57] ABSTRACT

A faucet attachment for diverting the flow of water from a faucet for drinking or other purposes including a first member which has a first chamber having first and second openings. The first member is linked to the faucet and is movable relative to same. A second member having a second chamber is also provided. The second chamber has first and second openings to the same. A connector possessing a passageway connects the first and second chambers. The second member is movable relative to the first member.

4 Claims, 2 Drawing Sheets

SPIGOT WATER FOUNTAIN

BACKGROUND OF THE INVENTION

The present invention relates to a novel faucet attachment which diverts the flow of water from the faucet.

In the past, many attachments have been devised for converting a faucet into a drinking fountain. For example, attachments have been purposed which generally rotate about the vertical axis of the faucet. For example, U.S. Pat. Nos. 487,842, 1,096,021, 1,114,051, 2,474,286, 2,878,059, 3,108,748, 3,533,554 show this type of device. Likewise, other attachments have been shown which rotate about an axis generally perpendicular to the axis of the faucet. For example, U.S. Pat. Nos. 1,994,454, 2,994,481, 3,062,452, 3,079,088, and 3,682,392 depict this type of device.

It is often desirable to divert the flow of water from a faucet from a perpendicular stream to a variety of streams in a spherical realm. Such water diverting capability would permit the user to use a common faucet as a drinking fountain, a washing instrument, a filling device, and for other functions. Known prior art devices do not permit a common faucet to function in this manner.

A device which solve the problems noted in the prior art would be a great advance in the field of pluming and water delivery.

SUMMARY OF THE INVENTION

In accordance with the present invention a novel and useful faucet attachment for diverting flow of water therefrom is provided.

The faucet attachment of the present invention utilizes as one of its elements a first member which possesses a first chamber therewithin. The first member includes first and second openings which may serve as inlets and outlets thereto. Means is also provided for linking the first member to the faucet. Such linking may include a universal joint which permits a flow of water from the faucet to the first chamber of the first member. The first member also may rotate relative to a first axis through the first member. In general, the first axis may be deemed a vertical axis in many cases.

The attachment of the present invention also includes a second member which possesses a second chamber. Again, the second chamber includes first and second openings thereto which may serve as an inlet and an outlet to the second chamber. Means is also provided for permitting movement of the second member relative to the first member. Such movement may be a rotational movement about a axis passing through the second member. The second axis may be deemed as a generally horizontal axis and be orthogonally positioned relative to the first axis.

A connector having a passageway therethrough is linked to the first and second chambers to provide communication therebetween. The connector is sealed relative to the first and second members. In certain cases, the connector may include a groove on the exterior surface thereof. A pin selectively held by the first or second member extends into the connector groove. Thus, the connector and either the first or second member would rotate relative to the other member. A sealing relationship would be maintained during this rotation between the connector and either the first or second member.

Thus, a faucet attachment would be provided which possesses a double articulation such that each articulation is capable of movement. The attachment of the present invention is capable of directing water from a faucet in practically all directions relative to the faucet outlet.

It may be apparent that a novel and useful faucet attachment has been described hereinabove.

Is therefore an object of the present invention to provide a faucet attachment which quickly and easily connects to a conventional faucet and permits the diversion of water from the faucet to a large variety of directions.

It is another object of the present invention to provide a faucet attachment for diverting the flow of water which will convert a ordinary faucet into a drinking fountain.

Yet another object of the present invention is to provide a faucet attachment which is compact and provides diversion of water from a faucet in many directions.

A further object of the present invention is to provide a faucet attachment for diverting the flow of water from a faucet which maintains a sealing relationship with the faucet during the diversion process.

The invention possess other objects and advantages especially as concerns particular characteristics and features thereof which will become apparent as the specification continues.

For a better understanding of the invention reference is made to the hereinafter description of the preferred embodiments thereof which should be referenced to the above described drawings.

DESCRIPTION OF THE PREFERRED EMBODIMENTS

Various aspects of the present invention will evolve from the following detailed description of the preferred embodiments thereof which should be referenced to the heretofore described drawings.

Figure 1:
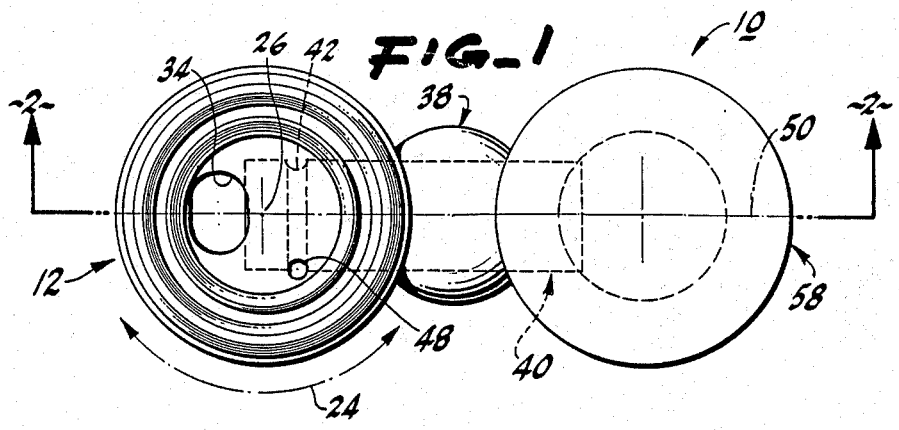
FIG. 1 is a top plan view of embodiment of the present invention depicting portions of the same in phantom.
Figure 2:
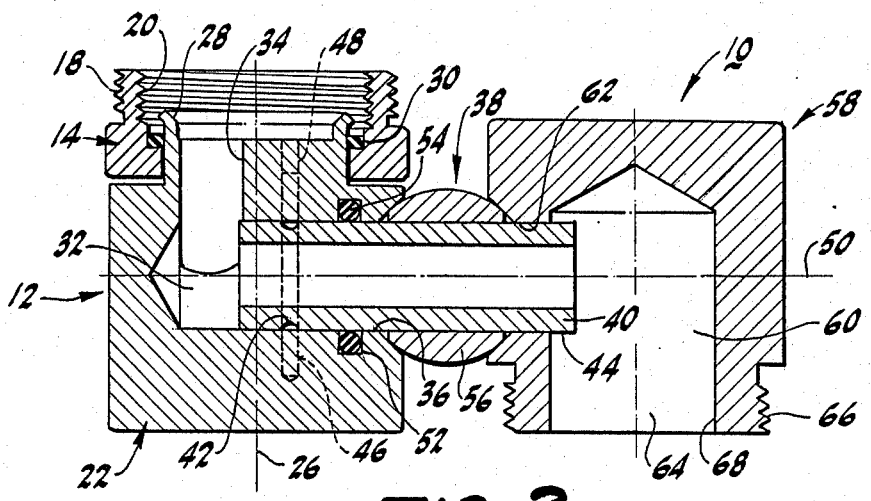
FIG. 2 is a sectional view taken along line 2—2 if FIG. 1.
Figure 3:
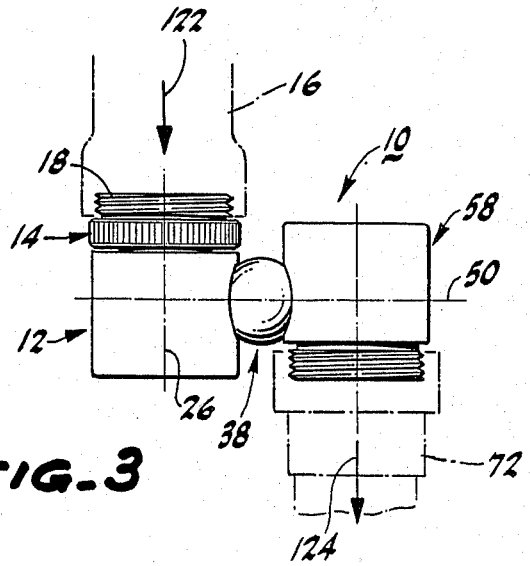
FIG. 3 is a side elevational view of the device of the present invention showing the water faucet in phantom and the flow pattern of water from the faucet through the attachment device.

The invention as a whole is denoted by reference character 10. Alternate embodiments of the present invention are denoted by reference character 10 with the addition of an upper case letter. With reference to FIG. 2 it may be seen that the faucet attachement 10 includes as one of its elements a first member 12. First member 12 is generally cylindrical in shape and includes an upper portion 14 which threadingly engages a faucet 16, shown in phantom FIG. 3. Upper portion 14 includes outer threaded surface 18 and inner threaded surface 20 for this purpose. Thus, upper portion 14 of first member 12 may threadingly engage faucet 16, if faucet 16 has an inner or outer thread. As shown in FIG. 3, faucet 16 possesses an inner thread, in this regard. First member 12 also includes a lower portion 22 which is rotatable relative to upper portion 14 of first member 12. Directional arrow 24 represents such rotation about axis 26. Lower portion 22 includes a flange 28 which maintains lower portion 22 in connection with upper portion 14. Seal ring 30 prevents leakage of water from faucet 16 between upper portion 14 and the lower portion 22 of first member 12. Thus, lower portion 22 of first member 12 is rotatable relative to faucet 16 about axis 26.

First member 12 includes a chamber 32 which possess openings 34 and 36, which serve as the inlet and outlet thereto, respectively.

The attachment of the present invention also possesses a connector 38 which partitionly occupies opening 36 of first member 12. Connector 38 includes a tube portion 40 having a groove 42 circumscribed about its outer surface 44. A pin 46 passes through a bore 48 in lower portion 22 of first member 12 and occupies a portion of groove 42. Pin 46 and groove 42 prevent movement of tube portion 40 along axis 50. It should be apparent from FIGS. 2 and 3 that axis 26 and axis 50 intersect one another and are orthogonally disposed relative to one another. First member 12 also includes a crevice 52 which circumscribes opening 36 and houses an o-ring 54. Crevice 52 and o-ring 54 seal the rotational connection of connector 38 with first member 12. Tube 40 also includes a toroidal member 56 which serves to protect connector 38 from mechanical damage. Toroidal member 56 fixes to outer surface 44 of tube portion 40 of connector 38.

Figure 4:
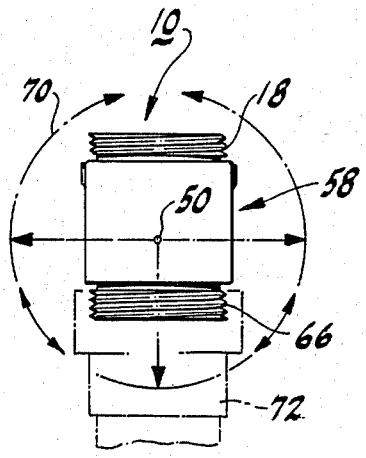
FIG. 4 is an end elevation view of the attachment shown in FIG. 3.

A second member 58 of attachment 10 fixes to tube portion 40 on the opposite side of toroidal member 56 proximate to first member 12. Second member 58 includes chamber 60 having openings 62 and 64 which serve as the inlet and outlet thereto. Second member is also constructed with a threaded lower surface 66 to accommodate aerater 72 or other attachments. It should be noted that a threaded surface may also be shown on the inner surface 68 of chamber 60 for this purpose. Although second member 58 and connector 38, fixed thereto, are rotatable relative to first member 12, second member may be rotatable to first member 38 having connector fixed thereto. With reference to FIG. 4 it may be seen that directional arrow 70 shows the rotation of second member 58 about axis 50.

Figure 5:
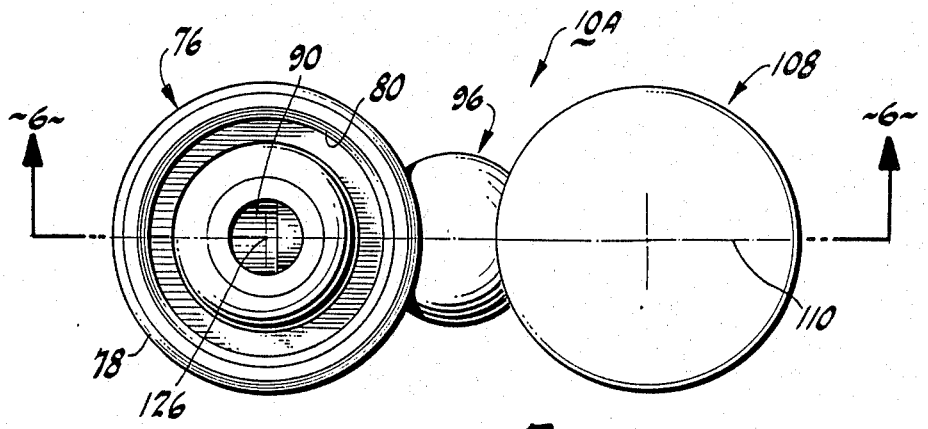
FIG. 5 is a top plan view of another embodiment of the present invention.
Figure 6:
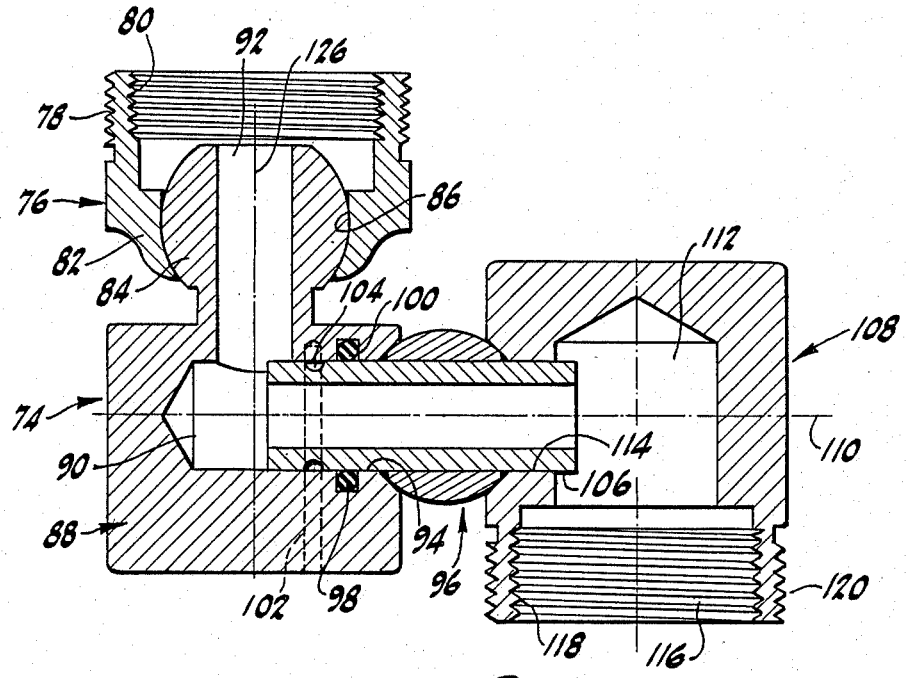
FIG. 6 is a section view taken along 6—6 of FIG. 5.

With reference to FIGS. 5 and 6, it may be observed that another embodiment of the present invention is shown. The attachment 10 A of FIGS. 5 and 6 include a first member 74 having an upper portion 76 with threaded surfaces 78 and 80. Again, threaded surfaces 78 and 80 are employed to connect first member 74 to a faucet such as faucet 16. First member 76 includes a bushing 82 which holds a spherical portion 84. Thus, a universal joint is formed between spherical portion 84 a curved surface 86 of bushing 82. Lower portion 88 of first member 74 includes a chamber 90 having inlet 92 and outlet 94. Connector 96 fits within outlet 94 and is sealed against leakage from chamber 90 by o-ring 98 and crevice 100 within lower portion 88 of first member 74. A pin 102 and groove 104 about the outer surface 106 of connector 96 hold connector 96 within opening 94.

Second member 108 fixes to connector 96 such that second member 108 and connector 96 rotate relative to first member 74 about axis 110. Chamber 112 includes inlet 114 and outlet 116. Threaded surfaces 118 and 120 permit the ussage of items such as aerater 72 of FIGS. 3 and 4.

In operation, the embodiment shown in FIGS. 1–4 is linked to faucet 16 permitting the flow of water from faucet 16 to first chamber 32 according to directional arrow 122, FIG. 3. Water enters chamber 32 without leakage since sealing ring 30 prevents the same. First member 12 is rotatable relative to faucet 16 about axis 26. Connector 38 and second member 58 are rotatable relative to axis 50. Water entering chamber 32 passes through tube portion 40 into chamber 60 of second member 58. From this point, water exits chamber 60 according to directional arrow 124.

Employing the embodiment showing FIGS. 5 and 6, first member 74 is movable universally relative to upper portion 76 thereof which would be attached to a faucet. Again, second member 108 is rotatable about axis 110.

Thus, the embodiments depicted in FIGS. 1–4 are able to direct water within a toroidal ring about axis 26. In the embodiment shown in FIGS. 5 and 6, water may be delivered in a section of a sphere about axis 126.

In the foregoing, embodiments of the present invention have set forth in considerable detail for the purpose of making a complete disclosure of the invention. However, it may be apparent to those of skill in the art that numerous changes may be made in such detail without departing from the spirit in principles of the invention.

What is claimed is:

1. A compact faucet attachment for diverting the flow of water from the faucet;

a. a first member including a first chamber therewithin, said first chamber including first and second openings thereto;

b. means for detachably linking said first member to the faucet, said linking means permitting flow of water from the faucet to said first chamber, said linking means permitting rotational movement of said first member relative to said faucet about a first axis passing through said first member;

c. a second member including a second chamber there within, said second chamber including first and second openings thereto;

d. a connector having a passageway therethrough, e. means for linking said connector to said first and second chambers such that said connector passage communicates with said first and second chambers, said connector being fixed to said second member for movement therewith, said connector having a portion extending into said first member and being movable relative thereto;

f. means for permitting movement of said second member relative to said first member including a groove on the exterior surface thereof and a pin selectively held by said first member, said pin extending into said connector groove; and g. means for sealing said connector relative to said first member, said sealing means being located along said connector portion extending into said first member, said pin held by said groove being located between said first chamber and said sealing means.

2. The faucet attachment of claim 1 in which said pin is movable in said groove with movement of said connector relative to said first member.

3. The faucet attachment of claim 1 in which said second member movement is a rotational movement about a second axis passing through said second member.

4. The faucet attachment of claim 3 in which said first and second axis are orthogonally positioned relative to one another.

* * * * *